US006678388B2

(12) United States Patent
Gotoh et al.

(10) Patent No.: US 6,678,388 B2
(45) **Date of Patent: *Jan. 13, 2004**

(54) ELECTROACOUSTIC TRANSDUCER

(75) Inventors: Youichi Gotoh, Sizuoka (JP); Yoshio Imahori, Sizuoka (JP); Yoshiharu Oishi, Shizuoka (JP); Kazuyasu Ono, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 135 days.

This patent is subject to a terminal disclaimer.

(21) Appl. No.: 09/941,738

(22) Filed: Aug. 30, 2001

(65) Prior Publication Data

US 2002/0025052 A1 Feb. 28, 2002

(30) Foreign Application Priority Data

Aug. 30, 2000 (JP) ..... P. 2000-261696

(51) Int. Cl.[7] ..... H04R 25/00

(52) U.S. Cl. ..... 381/417; 381/396; 381/407; 381/431

(58) Field of Search ..... 381/152, 396, 381/191, 398, 400, 407, 412, 417, 418, 420, 431; 340/825.46, 311.1; 367/175

(56) References Cited

U.S. PATENT DOCUMENTS 6,229,903 B1 * 5/2001 Kobayashi ..... 381/410
6,265,965 B1 * 7/2001 Lee ..... 381/412

* cited by examiner

*Primary Examiner*—Suhan Ni
(74) *Attorney, Agent, or Firm*—Sughrue Mion, PLLC

(57) ABSTRACT

An electroacoustic transducer (1) includes a base (24) and magnetic core (22) a diaphragm (20) supported with a gap between the diaphragm and a forward end of the magnetic core, a magnet (25) constituting a magnetic circuit together with the base (24), the magnetic core (22) and the diaphragm (20) a coil (23) disposed around the magnetic core a coil bobbin (30) for holding the coil (23), a housing (10) for receiving the above-mentioned members, a filler (19) applied to an external surface side of the base (24), and lead terminals (41 and 42) for supplying an electric current. The lead terminals (41 and 42) have protrusion portions (41*a* and 42*a*, protruding into an internal surface side of the base (24) in the axial direction of the coil. A coil wire (23*a*) is wound around the protrusion portions (41*a* and 42*a*) so as to be connected to the lead terminals (41 and 42).

7 Claims, 3 Drawing Sheets

ELECTROACOUSTIC TRANSDUCER

BACKGROUND OF THE INVENTION

1. Field of the Invention

The present invention relates to an electroacoustic transducer which generates a sound by means of electromagnetic acoustic conversion.

2. Description of the Related Art

An electroacoustic transducer has a magnetic circuit in which a magnetic field generated by a magnet passes through a base member, a magnetic core and a diaphragm and returns to the magnet again. When an electric oscillating signal is supplied to a coil wound around the magnetic core, an oscillating magnetic field generated by the coil is superimposed on the magnetostatic field of the magnetic circuit so that oscillation generated in the diaphragm is transmitted to air. Thus, sound is generated.

The electroacoustic transducer is provided with terminals for supplying a current to the coil, and the terminals are often connected to a wiring pattern of a circuit board by soldering or the like in the same manner as other electronic parts.

Conventionally, when coil terminal treatment is carried out for connecting a coil wire to terminals, the coil wire is led to the outside, and connected to the terminals provided on the external surface side of a base member. Further, a potting agent such as epoxy resin or the like is applied to the external surface side of the base member so as to protect the oil connection portions and seal the housing of the electroacoustic transducer.

A coil wire is extremely thin to be easily cut off if stress is imposed on the coil wire when the electroacoustic transducer is assembled or when it is mounted on an electronic apparatus. Thus, the reliability of the parts is degraded. It has been proved that if the potting agent comes in contact with the coil wire in the process of coil terminal treatment, the number of broken coil wires increases suddenly with the increase in the number of repeated thermal shocks in a thermal shock test in which the thermal shocks are repeated at fixed time intervals between a high temperature state and a low temperature state. It is considered that the coil wires are broken because an excessive load is applied to the coil wire due to the difference in the coefficient of thermal expansion between the potting agent and the coil wire. That is, in such a structure, it is difficult to enhance the durability of the coil wire in the terminal shock test.

In addition, since current-supplying terminals are exposed to the outside, there are many opportunities to impose stress on the terminals due to physical contact, soldering, and so on. Thus, the coil wire is apt to be broken due to excessive stress imposed on the terminals.

SUMMARY OF THE INVENTION

It is an object of the present invention to provide an electroacoustic transducer of high reliability in which stress imposed on a coil wire can be reduced.

According to the present invention, there is provided an electroacoustic transducer comprising: a base member made of magnetic material; a magnetic core made of magnetic material and provided erectly on the base member; a diaphragm made of magnetic material and supported with a gap between the diaphragm and a forward end of the magnetic core; a magnet constituting a magnetic circuit together with the base member, the magnetic core and the diaphragm so as to provide a magnetostatic field; a coil disposed around the magnetic core for applying an oscillating magnetic field to the magnetic circuit; a coil bobbin interposed between the magnetic core and the coil for holding the coil; a housing member for receiving the base member, the magnetic core, the diaphragm, the magnet, the coil and the coil bobbin; a filler applied on an external surface side of the base member; and terminals for supplying an electric current from the outside; wherein each of the terminals has a protrusion portion protruding into an internal surface side of the base member, and an end of the coil is connected to the protrusion portion.

According to the present invention, protrusion portions are provided in the terminals so as to protrude into the internal surface side of the base member. The coil wire, the end of the coil is connected to the protrusion portions, and a filler such as a potting agent is applied to the external surface side of the base member. Thus, the coil wire is prevented from being in contact with the filler so that it is possible to eliminate the stress imposed on the coil wire in a thermal shock test or the like.

In addition, even if stress is imposed on the external exposed portions of the terminals due to physical contact, soldering, or the like, it becomes difficult to transmit the stress from the external exposed portions to the protrusion portions. It is therefore possible to reduce the stress imposed on the coil wire. In addition, a connection treatment portion is received inside the transducer so as to be prevented from being exposed to the outside. It is therefore possible to improve the reliability of the terminal connection portion.

Further, according to the present invention, preferably, the protrusion portions protrude in a coil axial direction.

According to the present invention, the protrusion portions are made to protrude in the coil axial direction. Thus, the axis of rotation with which the coil wire is wound around the coil bobbin becomes parallel with the axis of rotation with which the coil wire is wound around each of the protrusion portions. By use of a coil winder, the coil wire is first wound around one protrusion portion, second around the coil bobbin, and third around the other protrusion portion. Through such a step, coil winding and coil terminal treatment can be carried out by a series of procedures. It is therefore possible to simplify the manufacturing process and to reduce the cost.

According to the present invention, preferably, the coil bobbin is molded integrally with the base member.

According to the present invention, the coil bobbin is molded integrally with the base member by insert molding or the like. Thus, it is not necessary to bond the coil bobbin. It is therefore possible to improve the fixation strength of the coil bobbin to the base member, and it is possible to simplify the manufacturing process and to reduce the cost.

DETAILED DESCRIPTION OF THE PRESENT INVENTION

The present invention will be described in detail with reference to the accompanying drawings.

Figure 1:
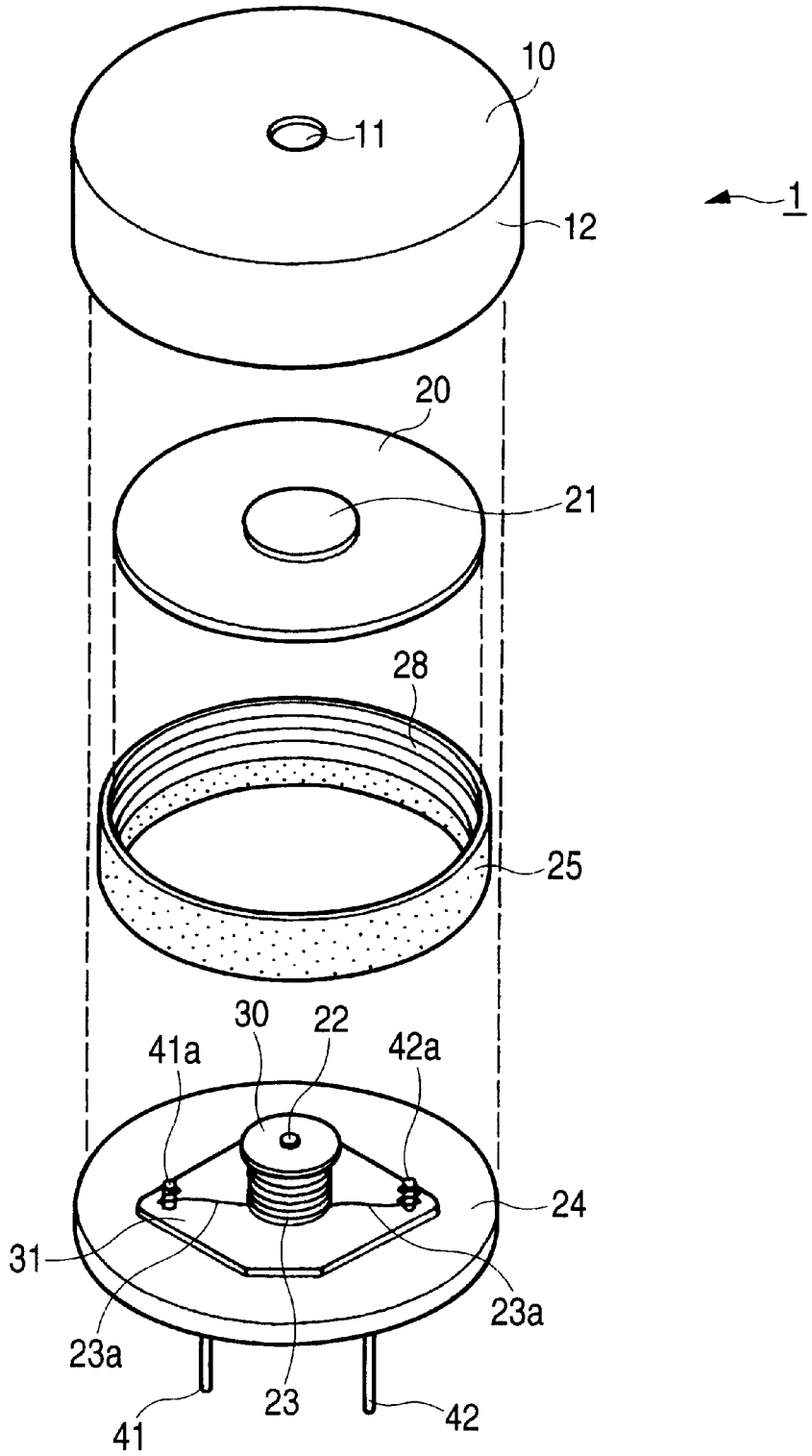
FIG. 1 is an exploded perspective view showing an embodiment of the present invention.
Figure 2:
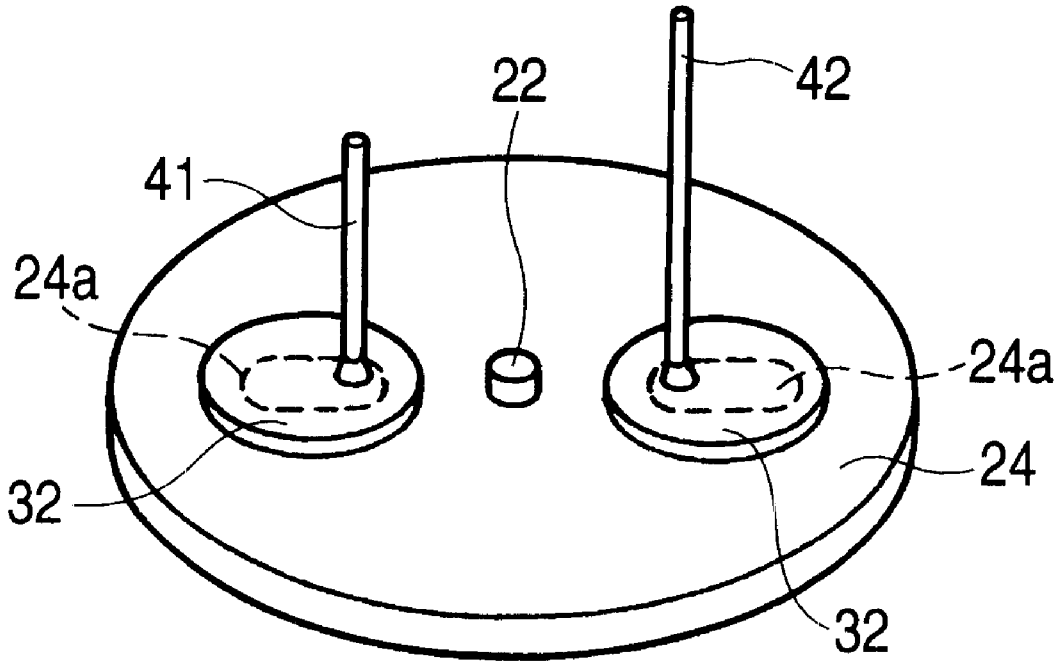
FIG. 2 is a perspective view showing the back surface side of a base 24.
Figure 3A:
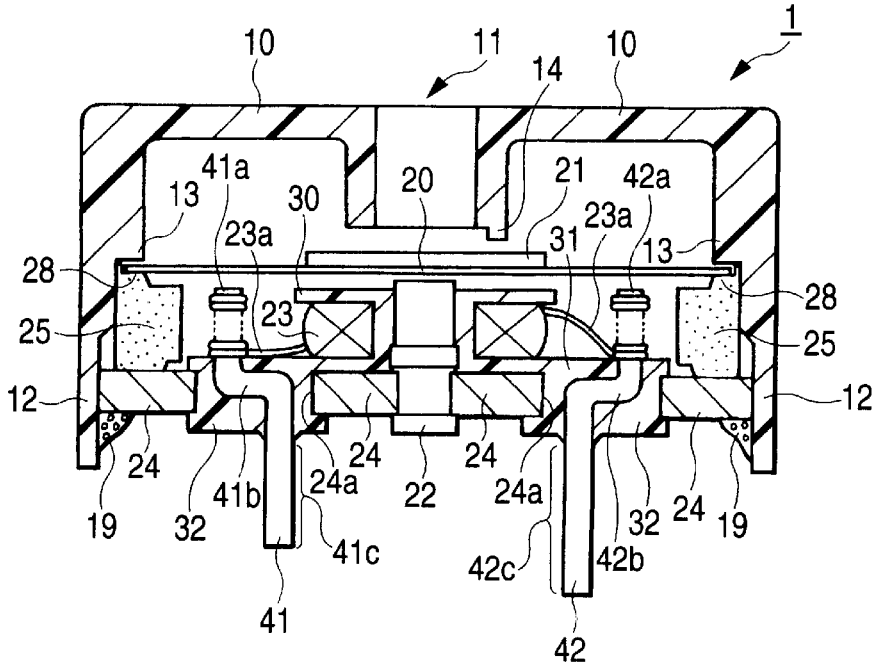
FIG. 3A is a sectional view taken on line vertical center line showing the embodiment of the present invention.
Figure 3B:
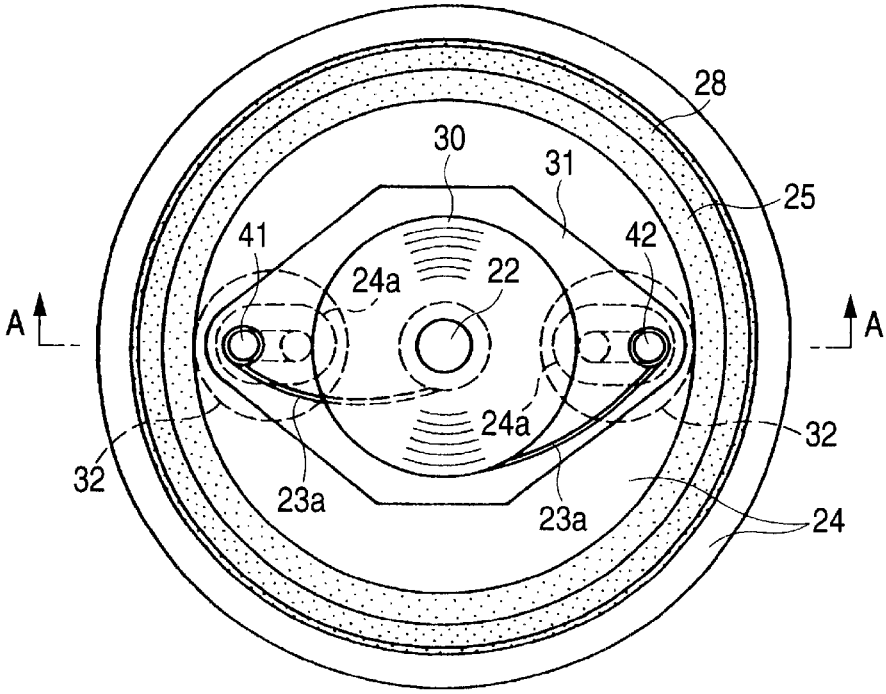
FIG. 3B is a plan view showing the state where a magnet 25 is mounted on the base 24.

FIG. 1 is an exploded perspective view showing an embodiment of the present invention. FIG. 2 is a perspective view showing the back surface side of a base 24. FIG. 3A is a sectional view taken on line vertical center line showing the embodiment of the present invention, and FIG. 3B is a plan view showing the state where a magnet 25 is mounted on the base 24.

An electroacoustic transducer 1 comprises a base 24, a magnetic core 22, a coil 23, a magnet 25 and a diaphragm 20, which are received in a housing 10. The electroacoustic transducer 1 is formed into a compressed column as a whole. For example, the entire size thereof is about diameter 25 mm by body height 12 mm.

The base 24 is formed into a disc having a diameter to be loosely fitted into the inner diameter of the housing 10. Each of two elliptic through holes 24*a* is formed at a fixed distance from the center of the base 24. Lead terminals 41 and 42 pass through the elliptic through holes 24*a* respectively, and an electrically insulating portions 32 are attached to the base 24 to thereby prevent short-circuit between the base 24 and the lead terminals 41 and 42.

A columnar magnetic core 22 is provided erectly at the center of the base 24, and a coil 23 is disposed around the magnetic core 22. The base 24 and the magnetic core 22 are made of magnetic material. However, the base 24 and the magnetic core 22 may be formed integrally as a single pole piece member by caulking or the like.

The magnet 25 is formed into a ring and disposed on the base 24 coaxially with the magnetic core 22. An annular internal space is ensured between the magnet 25 and the coil 23.

The magnet 25 is also used as a support member for supporting the diaphragm 20. As shown in FIG. 3A, a plurality of annular steps are formed in the inner side of the magnet 25. The disc-like diaphragm 20 is mounted on a horizontal supporting step 28 which is one of the annular steps so that the circumferential edge portion of the diaphragm 20 is positioned by the horizontal supporting step 28.

The diaphragm 20 is made of magnetic material. A fixed gap is ensured between the back center of the diaphragm 20 and the forward end of the magnetic core 22. A disc-like magnetic piece 21 is fixed to the front center of the diaphragm 20 so as to increase the mass of the diaphragm 20. Thus, the efficiency of oscillation of the air is enhanced.

The housing 10 is made of synthetic resin such as thermoplastic resin or the like, into a cylindrical box fitted to the outer-diameter shape of the base 24. A restriction portion 13 for positioning the magnet 25 and the diaphragm 20 is formed in the internal surface of the circumferential wall 12 of the housing 10 so as to position and fix the magnet 25 without using any bonding agent.

The circumferential wall 12 of the housing 10 and the base 24 are sealed and bonded by a filler 19 such as a bonding agent or molding resin, as shown in FIG. 3A.

A sound release aperture 11 having a smaller diameter than that of the magnetic piece 21 is formed in the top plate of the housing 10 so as to be opposed to the diaphragm 20. A displacement restriction portion 14 is formed at a predetermined distance from the magnetic piece 21 in the lower surface of the sound release aperture 11.

A coil bobbin 30 for holding the coil 23 is fitted to the magnetic core 22. The coil bobbin 30 is made of electrically insulating material such as synthetic resin or the like. The coil bobbin 30 has an upper flange and a lower flange 31 for restricting the upper and lower ends of the coil 23 respectively. The coil bobbin 30, together with the electrically insulating portions 32, are molded integrally with the magnetic core 22, the base 24 and the lead terminals 41 and 42 by insert molding or the like. By such integral molding, it is not necessary to bond the coil bobbin 30. It is therefore possible to improve the fixation strength of the coil bobbin 30, and it is possible to simplify the manufacturing process and to reduce the cost.

The lead terminals 41 and 42 are made of copper wires plated with solder, or the like. The lead terminals 41 and 42 have protrusion portions 41*a* and 42*a* protruding into the internal surface side of the base 24, bent portions 41*b* and 42*b* bent from the protrusion portions 41*a* and 42*a* toward the center, and exposed portions 41*c* and 42*c* protruding from the bent portions 41*b* and 42*b* into the external surface side of the base 24, respectively.

The protrusion portions 41*a* and 42*a* protrude in the coil axial direction so that the axis of rotation with which the coil wire 23*a* is wound around the coil bobbin 30 becomes substantially parallel with the axis of rotation with which the coil wire 23*a* is wound around each of the protrusion portions 41*a* and 42*a*.

According to such a configuration, by use of a coil winder, the coil wire 23*a* is first wound around the protrusion portion 41*a*, second around the coil bobbin 30, and finally around the protrusion portion 42*a*. Through such a step, coil winding and coil terminal treatment can be carried out by a series of steps. It is therefore possible to simplify the manufacturing process and to reduce the cost.

In addition, the coil wire 23*a* is connected to the protrusion portions 41*a* and 42*a* protruding into the internal surface side of the base 24. Thus, when the filler 19 is applied to the external surface side of the base 24, the coil wire 23*a* is prevented from being in contact with the filler 19. It is therefore possible to eliminate the stress imposed on the coil wire 23*a* in a thermal shock test or the like.

In addition, even if stress is imposed on the exposed portions 41*c* and 42*c* of the lead terminals 41 and 42 due to physical contact, soldering, or the like, it is difficult to transmit the stress from the exposed portions 41*c* and 42*c* to the protrusion portions 41*a* and 42*a*. It is therefore possible to reduce the stress imposed on the coil wire 23*a*.

The lower flange 31 of the coil bobbin 30 is formed to be broad enough to surround the protrusion portions 41*a* and 42*a*. By the lower flange 31, the coil wire 23*a* extending over the protrusion portion 41*a*, the coil bobbin 30 and the protrusion portion 42*a* is prevented from coming in contact with the base 24.

The bent portions 41*b* and 42*b* of the lead terminals 41 and 42 have a function to prevent the lead terminals 41 and 42 from being detached, and a function to convert the pitch of the protrusion portions 41*a* and 42*a* and the pitch of the exposed portions 41*c* and 42*c*.

If the lead terminals 41 and 42 are formed to be straight, the lead terminals 41 and 42 are fixed to the electrically insulating portions 32 simply by friction. On the other hand, if the bent portions 41*b* and 42*b* are formed in the middle portions of the lead terminals 41 and 42, the lead terminals 41 and 42 are engaged with the electrically insulating portions 32 firmly. Accordingly, the lead terminals 41 and 42 can be surely prevented from being detached from the electrically insulating portions 32 in the longitudinal direction.

In addition, it is necessary to ensure a space between each of the protrusion portions 41*a* and 42*a* and the coil bobbin 30 so that an arm head of the coil winder can pass through the space. When the bent portions 41*b* and 42*b* are provided thus, the pitch of the exposed portions 41*c* and 42*c* can be adjusted flexibly to the shapes of lands formed on an external circuit board.

Next, the operation will be described. The magnet 25 is magnetized in the direction of thickness so that the bottom and the top of the magnet 25 are magnetized into N and S poles respectively by way of example. In this case, magnetic line of force from the bottom of the magnet 25 passes through the circumferential edge portion of the base 24, the center portion of the base 24, the magnetic core 22, the center portion of the diaphragm 20, the circumferential edge portion of the diaphragm 20 and the top of the magnet 25. Thus, a closed magnetic circuit is formed as a whole. The magnet 25 has a function to apply a magnetostatic field to such a magnetic circuit. The diaphragm 20 is supported stably by this magnetostatic field in the condition that the diaphragm 20 is attracted toward the magnetic core 22 and the magnet 25.

When an electric oscillating signal is supplied from the circuit board through the lead terminals 41 and 42 and the coil wire 23*a* to the coil 23 which is wound around the magnetic core 22, the coil 23 applies an oscillating magnetic field to the magnetic circuit. Thus, the diaphragm 20 oscillates due to the superimposition of the oscillating magnetic field on the magnetostatic field so as to oscillate the air on the front surface side of and on the back surface side of the diaphragm 20.

Sound generated on the front surface side of the diaphragm 20 is released to the external environment through the sound release aperture 11. Sound generated on the back surface side of the diaphragm 20 has a phase inverse to that of the sound generated on the front surface side of the diaphragm 20. Therefore, by confining the sound generated on the back surface side of the diaphragm 20 in the annular internal space, the interference of the sound generated on the back surface side of the diaphragm 20 with the sound generated on the front surface side of the diaphragm 20 is restrained to be as small as possible.

Although the present invention has described about the case where the filler 19 is applied on the circumferential edge portion of the base 24 by way of example, the filler 19 may be applied to cover all the back surface of the base 24.

As described above, according to the present invention, a coil wire is connected to protrusion portions protruding into the internal surface side of a base member. Accordingly, the coil wire is prevented from being in contact with a filler so that it is possible to eliminate the stress imposed on the coil wire in a thermal shock test or the like. In addition, coil terminals are treated inside the base member. Accordingly, even if stress is imposed on the coil terminals due to physical contact of the terminals, soldering of the terminals, or the like, it is possible to reduce the stress imposed on the coil wire. In addition, coil winding and coil terminal treatment can be carried out by a series of steps. It is therefore possible to simplify the manufacturing process and to reduce the cost.

In addition, the protrusion portions are made to protrude in the coil axial direction. Accordingly, coil winding and coil terminal treatment can be carried out by a series of steps. It is therefore possible to simplify the manufacturing process and to reduce the cost.

Further, the coil bobbin is molded integrally with the base member by insert molding or the like. Thus, it is not necessary to bond the coil bobbin. It is therefore possible to improve the fixation strength of the coil bobbin to the base member, and it is possible to simplify the manufacturing process and to reduce the cost.

What is claimed is:

1. An electroacoustic transducer comprising:

a base member made of magnetic material;

a magnetic core made of magnetic material and provided erectly on the base member;

a diaphragm made of magnetic material and supported with a gap between the diaphragm and a forward end of the magnetic core;

a magnet constituting a magnetic circuit together with the base member, the magnetic core and the diaphragm to provide a magnetostatic field;

a coil disposed around the magnetic core for applying an oscillating magnetic field to the magnetic circuit;

a coil bobbin interposed between the magnetic core and the coil and molded integrally with the base member, for holding the coil;

a housing member for receiving the base member, the magnetic core, the diaphragm, the magnet, the coil and the coil bobbin;

a filler applied to an external surface side of the base member; and a terminal for supplying an electric current from an outside, wherein the terminal has a protrusion portion protruding to an internal surface side of the base member, and an end of the coil is connected to the protrusion portion of the terminal.

2. The electroacoustic transducer according to claim 1, wherein the protrusion portion protrudes in an axial direction of the coil.

3. The electroacoustic transducer according to claim 1, wherein the end of the coil is connected to the protrusion portion of the terminal between the base member and the housing member.

4. The electroacoustic transducer according to claim 1, further comprising an insulating portion integrally formed with the coil bobbin, wherein the terminal is fixed to the insulating portion.

5. The electroacoustic transducer according to claim 4, wherein the insulating portion insulates the terminal from the base member.

6. The electroacoustic transducer according to claim 4, wherein the insulating portion defines a hole for passing the terminal so that the protrusion portion of the terminal protrudes between the base member and the housing member.

7. The electroacoustic transducer according to claim 6, wherein a bent portion is formed in the middle of the terminal, and engaged with the inside of the hole of the insulating portion.

* * * * *